United States Patent [19]

Jenkins

[11] Patent Number: 4,974,914

[45] Date of Patent: Dec. 4, 1990

[54] HOUSEHOLD REFRIGERATOR ASSEMBLY

[75] Inventor: Thomas E. Jenkins, Louisville, Ky.

[73] Assignee: General Electric Company, Louisville, Ky.

[21] Appl. No.: 478,462

[22] Filed: Feb. 12, 1990

[51] Int. Cl.[5] ..... F25D 11/00

[52] U.S. Cl. ..... 312/214; 312/236

[58] Field of Search ..... 312/214, 236

[56] References Cited

U.S. PATENT DOCUMENTS

| | | | |
|---|---|---|---|
| 3,380,615 | 4/1968 | Kessler . | |
| 3,588,214 | 6/1971 | Stimamiglio . | |
| 3,642,164 | 2/1972 | O'Neal et al. | 312/214 |
| 3,912,349 | 10/1975 | Hoetker . | |
| 4,134,626 | 1/1979 | Kordes . | |
| 4,311,351 | 1/1982 | Chang . | |

*Primary Examiner*—Joseph Falk

*Attorney, Agent, or Firm*—Radford M. Reams; H. Neil Houser

[57] ABSTRACT

A refrigerator cabinet having an outer metal shell and an inner liner spaced from the shell with foamed-in-place thermal insulation therebetween. The cabinet has an outer metal shell open at the front with two side walls and a top wall each folded to provide a front face with an open fold behind the front face. There is a machinery compartment wall near the bottom of the refrigerator cabinet which is bent upwardly and terminates in a curved front lip having a downwardly facing opening. The inner liner has a peripheral flange which is received in the open fold behind the front face along the side and top walls. At the bottom of the cabinet is a bottom rail assembly which includes a metal cross member with each end secured to the front face at each of the side walls. The metal cross member has a strengthening groove extending between the ends and also has two spaced tabs formed to project downwardly into the groove. There is a snap-on trim member extending the length of the cross member and secured along the top edge and has a front vertical wall engaging the front surface of the cross member terminating at the bottom in a reverse bend hook with the end of the hook engaging the tabs of the cross member. The front vertical wall has an open reverse bend at the top to form a rear wall engaging the rear surface of the cross member. The rear wall has an open reverse bend away from the cross member to receive the bottom peripheral flange of the inner liner and forming an upwardly extending leg having a terminal end received in the downwardly facing opening of the lip of the compartment wall. With this structural arrangement the bottom rail assembly prevents egress of foam past the bottom peripheral flange of the inner liner and past the lip of the machinery compartment wall during the foamed-in-place thermal insulation operation.

4 Claims, 3 Drawing Sheets

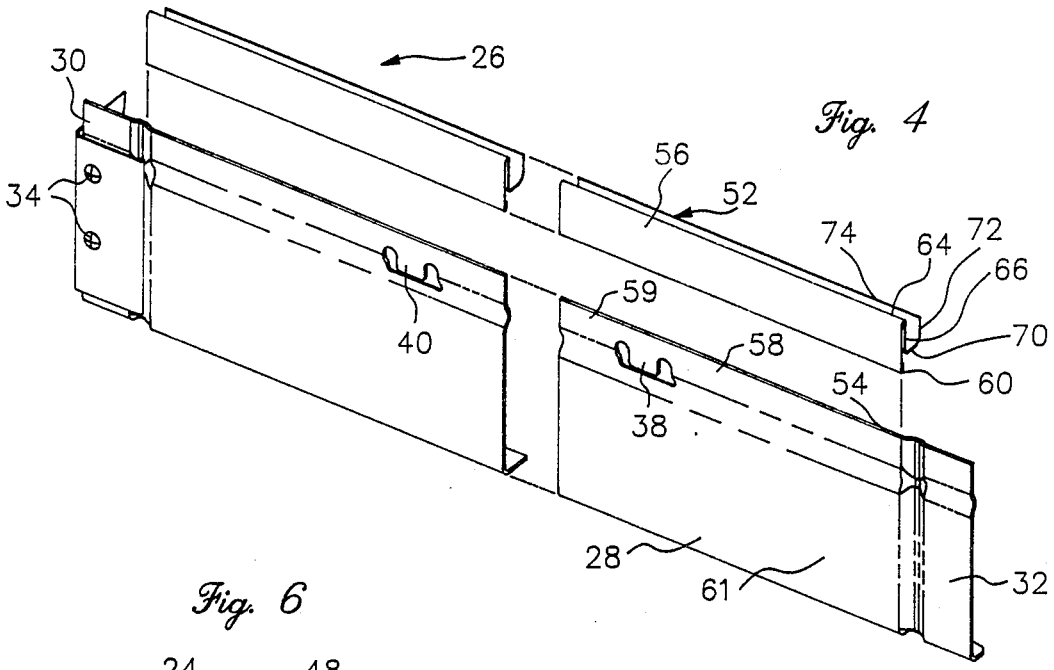
Fig. 4
Fig. 6
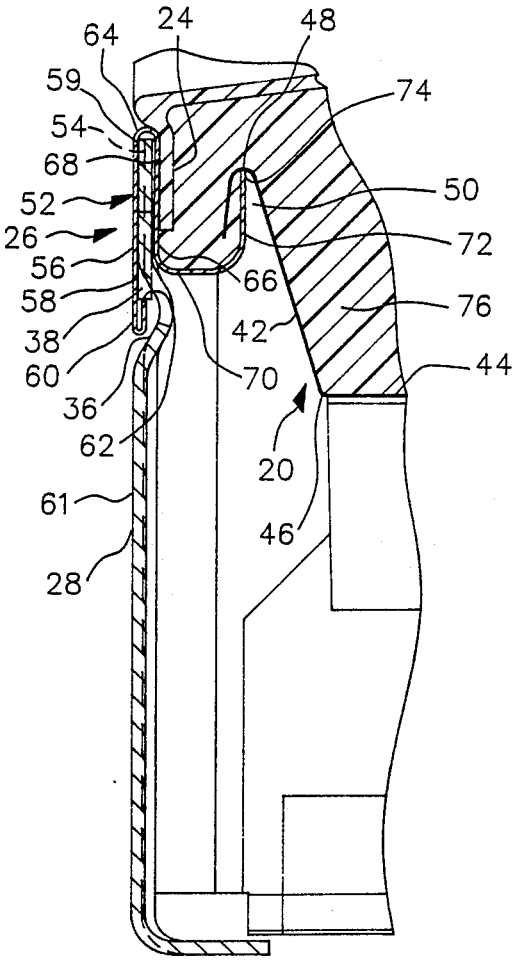
Fig. 5
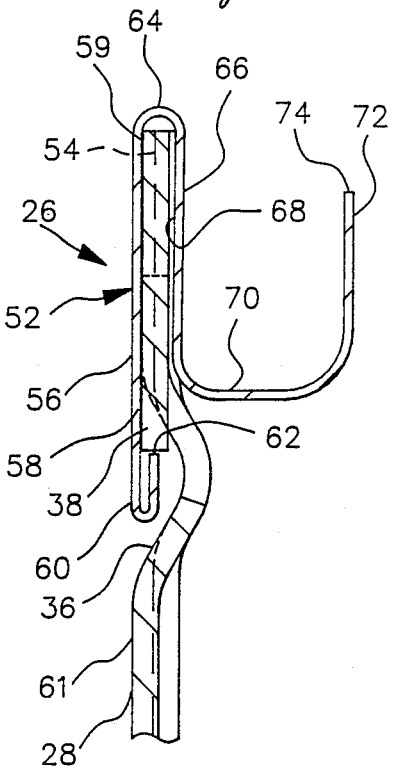

HOUSEHOLD REFRIGERATOR ASSEMBLY

BACKGROUND OF THE INVENTION

This invention relates to cabinet construction and, in particular, to a refrigerator appliance cabinet construction.

At the bottom oF most household refrigerators there is usually a rigid front bottom rail secured to the bottom of each of the side walls of the outer metal shell of the cabinet which performs several functions. One of the main functions is to provide rigid support to the cabinet at the front and many times mobility wheels or other cabinet supports are mounted on the front rail. Insulated wall structures are known in these types of refrigerators wherein the cabinet or wall structure includes an inner panel or liner, an outer shell, and a body of foamed-in-place insulation therebetween. This insulation must be around all sides, top and bottom of the compartment within the refrigerator for storing food items. It is important in such refrigerator construction that the bottom of the food storage compartment be particularly well insulated because below the bottom wall is normally located the machinery compartment which houses the compressor, fans, etc. that generate a substantial amount of heat during operation. It is important that the front rail of the refrigerator be constructed to prevent the egress of foam under pressure during the foaming operation. It is therefore important that the front rail, the liner and the bottom wall of the refrigerator compartment be joined together in a structurally sound manner to prevent the egress of foam through those interconnected components during the foaming operation.

By this invention there is provided a household refrigerator assembly that joins the bottom front rail, the liner and the bottom wall of the compartment together in such a manner that egress of foam during the foaming operation is prevented and all of these components are rigidly joined together to provide a structurally sound refrigerator cabinet and a pleasing appearance front rail assembly.

SUMMARY OF THE INVENTION

There is provided a refrigerator cabinet having an outer metal shell and an inner liner spaced from the shell with foamed-in-place thermal insulation therebetween. There is an outer metal shell open at the front and having two side walls and a top wall, each folded to provide a front face with an open fold therebehind. Near the bottom of the cabinet is a machinery compartment wall, the front of which is bent upwardly and terminates in a curved front lip having a downwardly facing opening. The cabinet has an inner liner having a peripheral flange received in the open fold behind the front face along the side. There is a front bottom rail assembly which includes a metal cross member located at the bottom of the outer metal shell with its end secured to the front face of each of the side walls and having a strengthening groove extending between the ends with at least two spaced tabs being formed to project downwardly into the groove. There is a snap-on trim member extending the length of the metal cross member and secured thereto along the top edge and having a front vertical wall engaging the front surface of the cross member terminating at the bottom in a reverse bend hook with the end of the hook engaging the tabs. The top of the front vertical wall has an open reverse bend to form a rear wall engaging the rear surface of the cross member. The rear wall has an open reverse bend away from the cross member to receive the bottom peripheral flange of the inner liner and forming an upwardly extending leg spaced from the rear wall and having a terminal end received in the downwardly facing opening of the lip of the machinery compartment wall. With this construction the front bottom rail assembly prevents egress of foam past the bottom peripheral flange of the inner liner and past the lip of the machinery compartment wall during the foamed-in-place thermal insulation operation.

BRIEF DESCRIPTION OF THE DRAWINGS

FIG. 4 is a perspective view of the front rail of the present invention.

FIG. 5 is a cross sectional view of a portion of the front rail assembly of the present invention.

FIG. 6 is a cross sectional view of the completed assembly of the present invention.

DESCRIPTION OF THE PREFERRED EMBODIMENT

Figure 1:
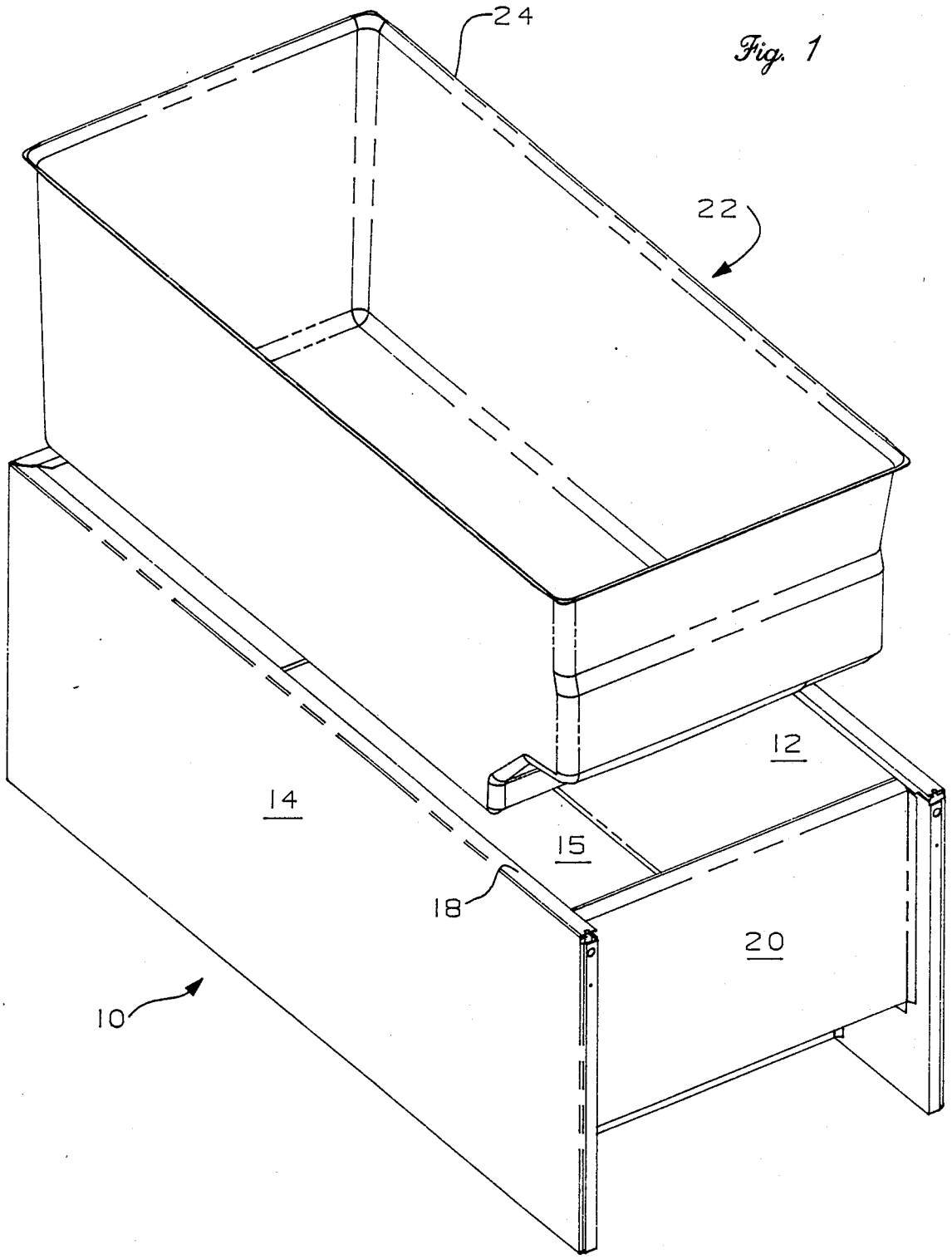
FIG. 1 is a perspective view showing the outer metal shell and inner liner of a household refrigerator.
Figure 2:
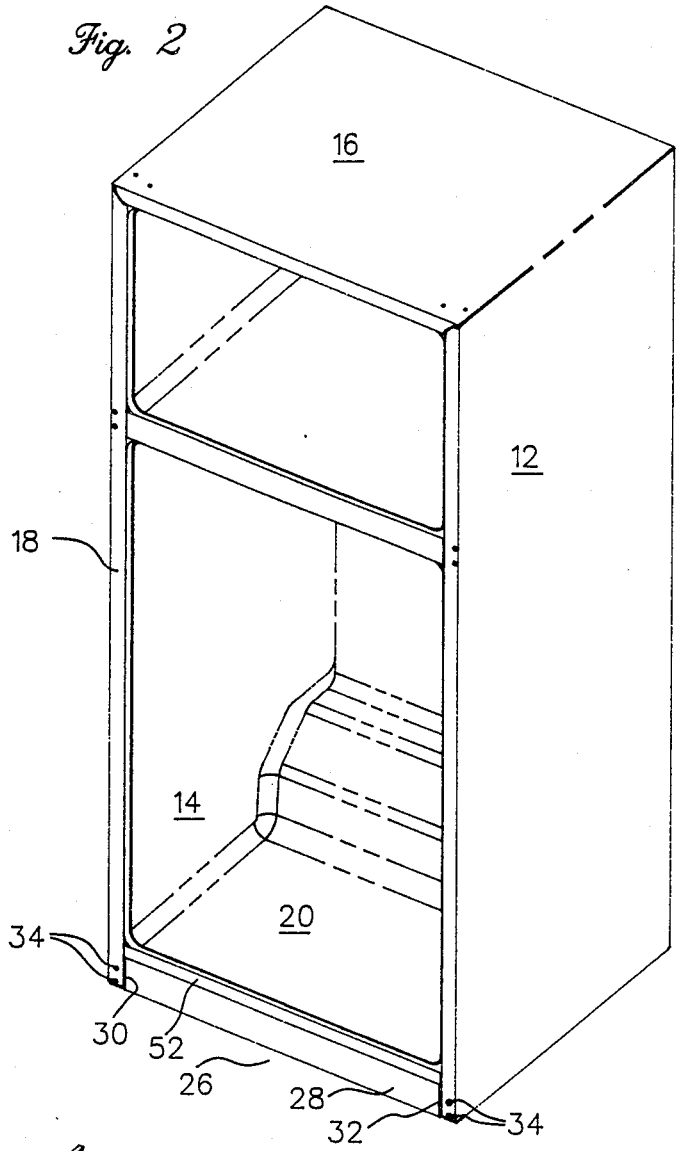
FIG. 2 is a perspective view of a portion of a household refrigerator utilizing the present invention.

With reference to FIGS. 1 and 2 in particular, there is shown a portion of a household refrigerator including an outer metal shell 10 which is made from a sheet of prepainted metal and folded to provide side walls 12 and 14 and top wall 16 interconnecting the side walls. The side walls and top wall are folded to provide a front face 18 which extends along each of the side walls and the top wall. The bottom of the outer metal shell 10 has a machinery compartment wall 20 which is separately formed and retained in place by suitable fastening to the side walls 12 and 14. The outer metal shell 10 during further assembly has a rear wall 15 which is separately formed and secured to the rear of the refrigerator cabinet and to the rear of the machinery compartment wall 20.

Figure 3:
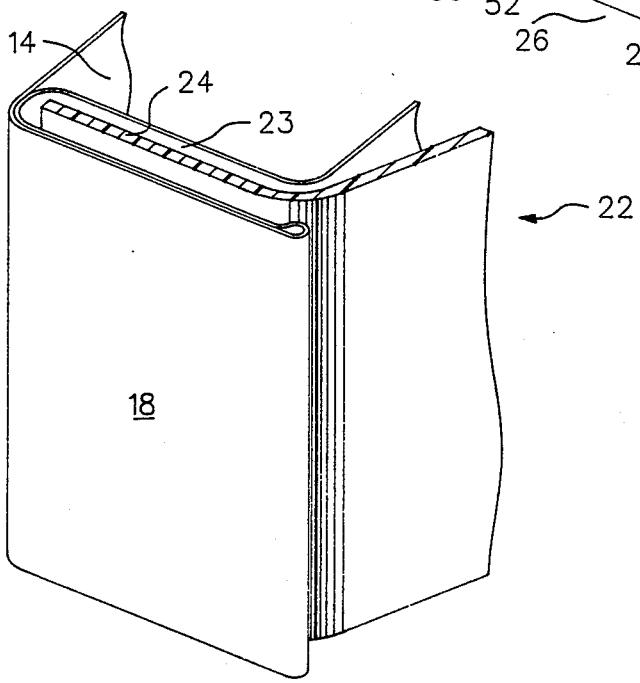
FIG. 3 is a perspective view showing the structural arrangement between the inner liner and the outer metal shell.

The household refrigerator also includes an inner liner 22 which may be formed of sheet metal or in most cases plastic by a blow molding process. The inner liner 22 is slightly smaller than the opening of the outer metal shell 10 between the side walls 12 and 14, top wall 16 and machinery compartment wall 20. The inner liner 22 has a peripheral outwardly extending flange 24 completely around the liner 22 and this flange 24 is to be received in a space 23 (FIG. 3) behind the front face 18 of the outer metal case when the liner is placed inside the outer case prior to the insulation foaming operation. During assembly of the household refrigerator the liner 22 is lowered into the outer metal shell 10 and when in proper position the foamed-in-place thermal insulation foaming operation takes place. In most cases the thermal insulation is a resin foam insulation medium interposed between the outer metal shell 10 and the inner liner 22. The foam is also introduced between the machinery compartment wall 20 and the liner 22 to thermally insulate the food storage compartment at the bottom of the refrigerator. The machinery compartment generates a significant amount of heat due to the operation of electric motors etc. that are utilized in the refrigerating system and housed between the machinery compartment wall and the bottom of the refrigerator. The foam or polyurethane compositions in liquid/gas form are introduced into the space between the outer metal shell, the machinery compartment wall and the inner liner and with a blowing agent is caused to expand throughout the space and then are solidified by curing. In practice, this solid foam which adheres to the outer metal shell, machinery compartment wall and inner liner not only insulates but adds rigidity to the cabinet structure. It is important that during the foamed-in-place thermal insulation operation that all of the apertures or openings in the outer metal shell, machinery compartment wall and liner be sealed to prevent the egress of the insulating material through the holes in these cabinet components.

With particular reference to FIGS. 2–6, the front bottom rail assembly 26 will be described. The assembly includes a metal cross member 28 located at the bottom of the outer metal shell 10 with its ends 30 and 32 secured to the front face 18 of each of the side walls 12 and 14 as by screws or pierce rivets 34. To enhance the strength of the metal cross member 28 there is provided a strengthening groove 36 extending between the ends 30 and 32. This strengthening groove is useful in resisting door stop torque on the lower hinge of the finally assembled refrigerator where these hinges support access doors for the refrigerator compartment. As seen in FIG. 4, the metal cross member 28 has at least two spaced tabs 38 and 40 formed to project downwardly into the groove 36. In the preferred embodiment these tabs are struck from the material of the metal cross member 28.

With reference to FIG. 6, the machinery compartment wall 20 has a front wall 42 being bent upwardly from the base 44 at corner 46 and terminates in a curved front lip 48 having a downwardly facing opening 50. The curved front lip 48 extends from one side wall to the other side wall of the outer metal shell 10.

The front bottom rail assembly 26 further includes a snap-on trim member 52 which extends the length of the metal cross member 28 and is secured thereto along the top edge 54 of the metal cross member. The snap-on trim member also has a front vertical wall 56 engaging the front surface 58 of the metal cross member 28 terminating at the bottom in a reverse bend hook 60 with the end 62 of the hook engaging the tabs 38 and 40 The top of the front vertical wall 56 has an open reverse bend 64 to form a rear wall 66 which engages the rear surface 68 of the metal cross member 28. The rear wall 66 has an open reverse bend 70 away from the cross member 28. This open reverse bend 70 as shown in FIG. 6 receives the bottom peripheral flange 24 of the inner liner 22 and also forms an upwardly extending leg 72 spaced from the rear wall 66 and having a terminal end 74 received in the downwardly facing opening 50 of the lip 48 of the machinery compartment wall 20.

With the above described structural arrangement for assembling a household refrigerator, the metal cross member 28 is securely fastened to the front face 18 of the side walls near the bottom of the cabinet to provide a rigid structural support for the front bottom of the cabinet. The snap-on trim member 50 fits over the top portion of the cross member 28 and extends down past the strengthening groove 36 and is retained in that position by the end of the hook 62 being positioned under the tabs 38 and 40. In the preferred embodiment the front vertical wall 56 of the snap-on trim member 52 is in the same vertical plane as the front surface 58 of the metal cross member 28. To accomplish this, the upper portion 59 of the cross member 28 is offset rearwardly from the bottom portion 61 a distance approximately that of the thickness of the front vertical wall 56. This arrangement provides a pleasing appearance to the refrigerator user when the access door to the refrigerator compartment is open. Moreover, the snap-on trim member 52 also provides a connection between the peripheral outwardly extending flange 24 along the bottom of the liner and also the curved front lip 48 of the machinery compartment wall 20. After those components are in the position as described and shown in FIG. 6, the space between the liner 22, the outer metal shell 10 and the machinery compartment wall 20 is subjected to the foamed-in-place operation and the foam 76 after expanding and curing fills the space between those components and bonds them all together to form a very solid and rigid assembly, the final form of which is shown in FIG. 6. In addition, because of this arrangement of these components during the foamed-in-place thermal insulation operation, the foam is prevented from leaking through any openings in the front bottom rail assembly. Moreover, with this structural arrangement the passage between the colder food storage compartment and the warmer machinery compartment is sealed, thus preventing the condenser fan located in the machinery compartment from drawing refrigerated air from the food storage compartment. Another advantage is that the raw edge of the terminal end 74 of the snap-on trim member 52 is covered to prevent corrosion. Still another advantage of this structural arrangement is that it helps prevent twisting of the metal cross member 28 under loading, thus giving additional structural integrity to the refrigerator.

The foregoing is a description of the preferred embodiment of the invention and it should be understood that variations may be made thereto without departing from the true spirit of the invention as defined in the appended claims.

What is claimed is:

1. A refrigerator cabinet having an outer metal shell and an inner liner spaced from the shell with foamed-in-place thermal insulation therebetween comprising:

an outer metal shell open at the front and having two side walls and a top wall, each folded to provide a front face with an open fold therebehind;

a machinery compartment wall located near the bottom of the outer metal shell, the front of the wall being bent upwardly and terminating in a curved front lip having a downwardly facing opening;

an inner liner having a peripheral flange received in the open fold behind the front face along the side and top walls; and a front bottom rail assembly including a metal cross member located at the bottom of the outer metal shell with its end secured to the front face at each of the side walls and having a strengthening groove extending between the ends, at least two spaced tabs being formed to project downwardly into the groove;

a snap-on trim member extending the length of the metal cross-member and secured thereto along the top edge and having a front vertical wall engaging the front surface of the cross-member terminating at the bottom in a reverse bend hook with the end of the hook engaging the tabs, the top of the front vertical wall having an open reverse bend to form a rear wall engaging the rear surface of the cross-member, said rear wall having an open reverse bend away from the cross-member to receive the bottom peripheral flange of the inner liner and forming an upwardly extending leg spaced from the rear wall and having a terminal end received in the downwardly facing opening of the lip of the machinery compartment wall, whereby, said front bottom rail assembly prevents egress of foam past the bottom peripheral flange of the inner liner and past the lip of the machinery compartment wall during the foamed-in-place thermal insulation operation.

2. The refrigerator cabinet of claim 1 wherein the metal cross member and snap-on trim member are made of pre-painted steel.

3. The refrigerator cabinet of claim 1 wherein the tabs are struck from the material of the metal cross member.

4. The refrigerator cabinet of claim 1 wherein the front vertical wall of the trim member and the front surface of the cross-member are in the same vertical plane.

* * * * *